US005219316A

United States Patent [19]

Huffman

[11] Patent Number: 5,219,316

[45] Date of Patent: Jun. 15, 1993

[54] PORTABLE, COMPACTIBLE ARMED COMPETITION ARENA AND APPARATUS

[76] Inventor: Rick Huffman, 227 Laws Ave., Ukiah, Calif. 95482

[21] Appl. No.: 739,745

[22] Filed: Aug. 2, 1991

[51] Int. Cl.[5] ..... A63J 11/00

[52] U.S. Cl. ..... 472/62

[58] Field of Search ..... 472/62; 52/71, 239, 52/64; 160/351, 135

[56] References Cited

U.S. PATENT DOCUMENTS

| | | | |
|---|---|---|---|
| 507,159 | 10/1893 | Palm | 472/62 |
| 4,154,440 | 5/1979 | Rusk | 472/62 |
| 5,046,720 | 9/1991 | Bolly | 472/62 |

OTHER PUBLICATIONS

Advertisement, price list, and invoice from Pro-Star Labs, Div. RMT Sports.
Article and drawing: Great for Ambushes, Assaults, Close-Range Action, and Indoors—The Perfect Back--Up Oct. 1990 advertisement from Wear Guard.
Personalization Worksheet, Screen Print Worksheet, and Order form from Wear Guard.
Advertisement from Hanes Thermal Underwear and Custom Embroidered Emblems.
Advertisement and order form for Wild Masks from Search, Mark S. Brewer, Consultant.
Advertisement from Adventure Game Supplies, Inc.
The Sting—Advertisement for JT Pursuit Products.
Magazine article: Products for Players.
Magazine article by Larry McKnight: Federal Court Victory.
Advertisement from Gen. Joe's.
Paintball magazine, 1990 Guns and Equipment Buyer's Guide.
Information regarding continuous hinges, Robert I. Merrill Co.
Information regarding Sturdi-Wood Industrial Specialty Panels by Weyerhaeuser Sturdi-Wood Engineered Strand Products.
Beam, Headers, Columns & Posts from MacMillan Bloedel.
Jan. 1991 Newsletter from International Paintball Players Association.
Calendar of Events and Membership Application for IPPA.
Jan. 1991 Advertisement for Bullseye Paint Ball Co.
Feb. 1991 IPPA Newsletter.
Article in Feb. 1991 Paintcheck magazine: Increasing Your Range by Ken Kelscli.
IPPA Magazine and Calendar of Events, Feb. 1991 Paintcheck Magazine.
Editorial by Randy Kamiya—The Future is Ours.
Article entitled CO2 Mail.
Advertisement for supplies from I & K Sports.
Articles and advertisements from magazine Action Pursuit Games.
Articles and advertisements from Sep. 1990 issue of Paint Check.
Articles and advertisements from Sep. 1990 issue of Paintball Sports.
Product Update from May 1991 issue of Security magazine.
Article: One Site Advanced Firearms and Tactics Training for Police Departments, Federal and State Agencies, Private Security.
Article by Jessica J. Sparks: Paintball: A Well-Kept Secret.
Advertisement for WGP Range.
Article from Mar., 1990 issue of Security magazine.
Advertisement for fencing from Barco Products Company.

*Primary Examiner*—Richard E. Chilcot, Jr.
*Attorney, Agent, or Firm*—Lynn G. Foster

[57] ABSTRACT

A portable self-supporting, compactible armed competition arena and associated apparatus which is readily manually dismantled after use at one site, stacked and transported, and manually assembled for use at another site. The arena comprises a floor covering comprising markings which layout a plan for the arena and upon which the arena is assembled. The markings comprise indicia which alpha-numerically or otherwise identify wall and other arena construction parts to be assembled at the marked locations. Wall parts and other arena parts identified by the floor covering markings likewise bear tags comprising identifiers which correlate with the markings such that each identified part has a predefined unique location on the floor covering and in the arena structure. Each vertical edge of each wall part which is manually assembled, is releasibly affixed to another part by a joint which is light tight. In some cases, hinges are used to connect two adjacent wall parts for easier assembly. The hinged connectors are also light tight. The arena is alternately used in-doors and out-of-doors. When totally assembled, the arena comprises a unitized structure which withstands wind and body loads. When used out-of-doors, tie-downs provide additional stability against wind load. Garb for participants includes headgear, coveralls, gloves, and boots. Headgear comprises a mask having full face, ear, temple and throat area protection for use with and without eye glasses.

52 Claims, 5 Drawing Sheets

PORTABLE, COMPACTIBLE ARMED COMPETITION ARENA AND APPARATUS

FIELD OF INVENTION

The present invention relates to apparatus used in law enforcement training and sporting activities involving the use of paintballs and other line-of-sight armed competition and in particular to compactible, portable apparatus which is used in urban or in-structure law enforcement training and in sporting activities involving the use of paintballs and other line-of-sight armed competition, wherein the apparatus is readily dismantled for transport after use at one site, transported and assembled for use at another site.

BACKGROUND AND DESCRIPTION OF RELATED ART

Use of paintballs and associated paintball apparatus in law enforcement training and sporting activities is widely known in the art. In addition to the use of paintballs and associated apparatus, a wide range of other law enforcement training apparatus and equipment is also known and available in the art. As examples, related law enforcement training and sporting activities involve use of firearms and live ammunition against passive targets, and person against person competition involves use of light emitting and reflected light sensing weapon simulating devices. However, of all the apparatus and equipment currently available, only the use of paintballs and associated paintball apparatus in person-to-person competition offers realism commensurate with real life law enforcement problems and activities. Congruently, sporting activities involving similar person against person competition add a realism which sets paintball sporting activities apart form other like person-against-person competition.

Generally activities involving use of firearms against passive targets which do not return fire hone reflexive shooting skills, but do not school a trainee to perform when the trainee may be both the hunter and the hunted. On the other hand, light emitting and reflective light sensing weapon simulating devices are limited by the area and angle of reflective targets to the emitted light ray, by the ability of a targeted individual to remove a reflective target from viewable access by the weapon, by possible reflection from something other than the target thereby producing a false positive hit, and by inability to check a result to determine whether or not a presumed hit had really occurred.

Paintball associated training and sporting activities generally involve person-to-person competition. One or more participants are directly pitted against one or more other participants. A common goal such as acquiring and moving a flag from one predetermined place to another designated place by a participant legitimately remaining in the competition is often used as the winning move. During the attempt to accomplish the winning move the player trying to acquire and transport the flag becomes a prime paintball target, although each participant in the competition is a potential target. A participant is removed from competition when receiving a mark from a paintball. Any player receiving a hit on any part of the body from a paintball, whether the ball breaks or not, is declared marked. Each player so marked must terminate participation in the competition and leave the activity site.

Special protective equipment is required when participating in a paintball activity. Such equipment comprises protective eyewear which may comprise a helmet and body and extremity coverings. Safety dictates the presence of at least one official during sporting events and at least one supervising instructor during training The officials and instructors are responsible for starting an activity, judging hit markings and disqualifying acts, verifying goal accomplishment, and declaring an end to each activity.

More common sites for paintball activities are out-of-doors; however, indoor sites, most often employed for recreational uses, are known. In some cases, both the indoor and out-of-doors sites comprise parts which are portable or dynamically moved during or between the activities, but they are most often free standing or individually used. Each of such sites is usually chosen and established where the land and neighborhood are permissive to a continuing and successful paintball activity and more or less permanently located thereat. For this reason, law enforcement training, using paintballs and associated equipment, is often either not available within a reasonable distance for regular training cycles or normally involves extended, time consuming travel.

BRIEF SUMMARY AND OBJECTS OF THE INVENTION

In brief summary, this novel invention alleviates all of the known problems related to providing a portable, compactible, indoor/outdoor armed competition arena which is readily manually dismantled for transport after use at one site, stacked and transported, and manually assembled for use at another site. The arena and associated apparatus comprises individual and hinged wall parts for the arena, a floor covering upon which the arena is constructed and upon which a plan for the arena walls is marked, and personal equipment which provides protective covering for each user.

Wall parts for the arena comprise side walls and inner walls, doorway, and window areas. In an assembled structure, each wall part is joined to at least two other wall parts on each side of the part, thereby providing a unitary structure where no part comprises an open end. Each part to part joint excludes any visual pathway such that each butt-end connection and each hinge connection is light tight thereby limiting viewing pathways within the arena to spaces defined by open windows and doorways.

Except for areas around each entrance, the side walls comprise screened windows to permit visual access by judges, trainers, supervisors, and spectators while providing protection against internally launched projectiles toward those outside the perimeter of the arena. At each entrance, an overhead support interconnects other adjoining wall parts to form a doorway. In areas, such as near entrances, vision obstructing panels are used In place of the panels comprising screened windows to limit visual access to entry movements by a competitor.

Inner walls comprise strategically placed vision obstructing parts and line-of-sight and user pathways comprising window and doorway parts. Inner wall parts are connected to other inner wall parts or to side wall parts such that a unitary construction is achieved.

To withstand wind loads and dynamically moving body loads a bracing member is provided at each non-planar wall intersection or corner. The bracing members comprise stabilizers, supports, braces and brackets located where exterior panels join without an interior panel supportably fastened thereto. Further, eyebolts are provided on the exterior or the side wall parts for tying the arena to anchored ground-stakes when the arena is assembled out of doors for an extended period of time and when the arena may be exposed to severe wind gusts.

A carpet comprising a pattern describing the layout of the walls of the arena is provided to aid assembly. Each panel is marked with a location identifier in the arena in the form a grid position number. The same identifier is placed on the carpet pattern where the panel comprising the same identifier is located during assembly.

Commensurate with paintball user safety requirements user apparel and other apparatus is provided. User apparel comprises a mask, a hood which protect head parts not covered by the mask, and goggles. The mask is specially formed to cover and protect the full face, ear, temple, and throat area and, in at least one embodiment, comprises a headband which offsets the mask from the head of the wearer so that eyeglasses are accommodated. The mask permits the use of a large variety of goggle designs. Loose fitting coveralls and gloves provide torso and limb protection.

Accordingly, it is a primary object to provide a compactible, portable and self-supporting armed competition arena which is facilely manually dismantled for transport after use in one site, stacked and transported, and manually assembled for use at another site.

It is another primary object to provide a compactible, portable and self-supporting armed competition arena which is assembled for use both in-doors and out-of-doors It is another primary object to provide a compactible, portable and self-supporting armed competition indoor-/outdoor arena which withstands out-of-door wind loads and body loads exerted during competitive athletic activity.

It is another primary object to provide a compactible, portable and self-supporting armed competition arena which is used both as a training facility and as a sporting facility.

It is a basic object to provide a method for joining wall panels of the arena such that there is no visual pathway in the joint.

It is another basic object to provide a method for releasibly joining wall parts with bolts and nuts.

It is another basic object to provide a method for hingeably joining wall panels such that there is no visual pathway in the hinged joint.

It is another object to provide a floor support bracket located where exterior panels join, without an interior floor panel supportably fastened thereto at the joint.

It is another object to provide a tag or identifying plate for each wall panel such that each panel is related to a grid address on an assembly plan of the arena.

It is another object to provide a carpet which comprises a visible life-sized layout pattern upon which the arena is assembled.

It is another object to provide a carpet which comprises indicia associated with each panel used in the arena such that the tag or identifying plate for each panel is correlated with the indicia on the carpet for facile assembly.

It is another object to provide at least one layout for the arena which is symmetrical about a center line and which comprises a common goal or flag at the geometric center of the arena, and which thereby provides a competitive environment in which two teams approaching the flag from opposite directions are equally geographically disposed to acquiring the goal or flag.

It is another object to provide headgear for use in arena competition.

It is another object to provide a mask which is part of the headgear which protects facial and related head parts including the full face, ear, temple, and throat area and which fits participants with and without eye glasses.

These and other objects and features of the present invention will be apparent from the detailed description taken with reference to accompanying drawings.

DETAILED DESCRIPTION OF THE ILLUSTRATED EMBODIMENTS

In this description, the term proximal is used to indicate the segment of an apparatus or part of an apparatus which is normally closest to the viewer when seen. The term distal refers to the other side of the apparatus or part of the apparatus. Reference is now made to the embodiments illustrated in FIGS. 1–14, wherein like numerals are used to designate like parts throughout.

Figure 1:
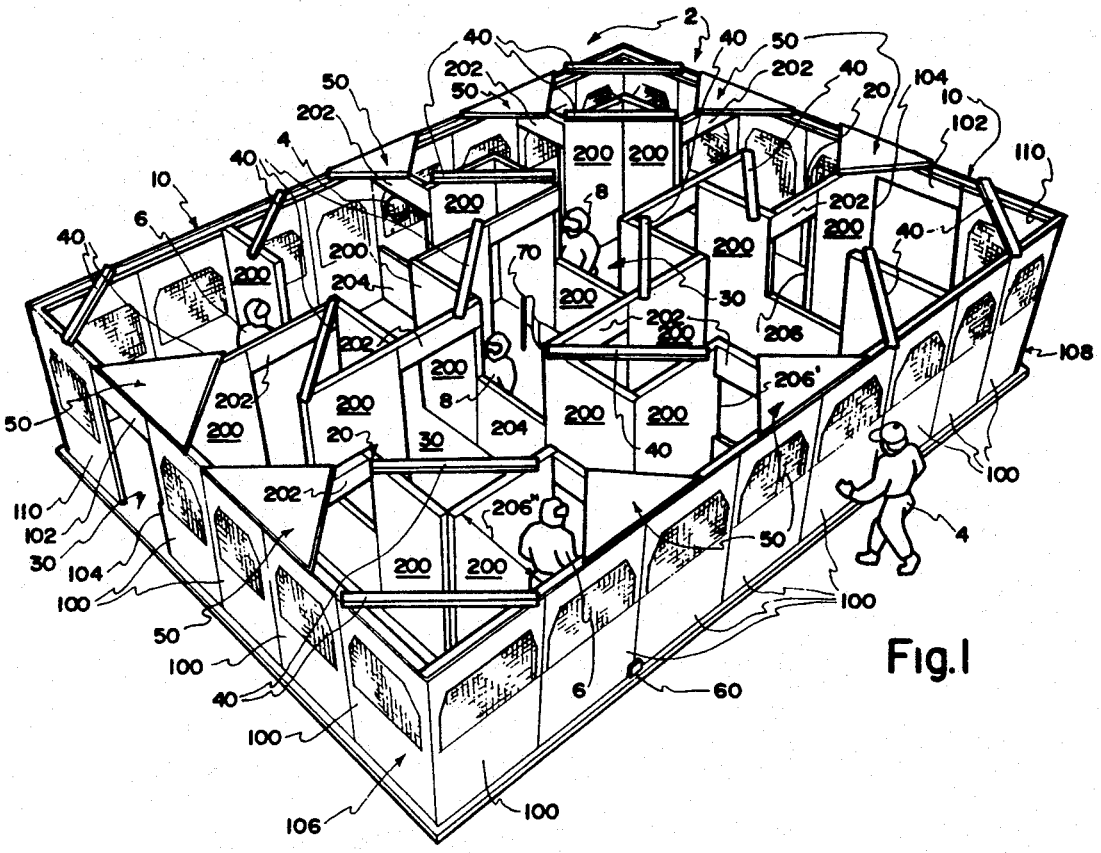
FIG. 1 is a perspective of a completely assembled arena.

The invention comprises an arena and other associated parts which are described in detail later. A currently preferred embodiment of this novel invention in the form of an arena 2 is seen in FIG. 1. Arena 2 provides a facility wherein participants engage in line-of-sight armed competition. As such, arena 2 is particularly useful in training police officers, SWAT team members, and other personnel who require special training preparatory to being called upon to use tactical operations comprising the use of firearms. While both permanent and semipermanent indoor and out-of-door line-of-sight competition facilities are known, they are usually found in areas remote from training and retraining centers and are therefore relatively inaccessible for regular or periodic training. Such permanent facilities are often more expensive and require more space than can be allocated for relatively seldomly performed training. Further compounding the problem of using distant facilities, remote training sites generally require unacceptably inefficient use of training time for travel.

Remarkably different from permanent or semipermanent facilities, arena 2 is readily dismantled at a last used site, transported, and easily reassembled at another site. Each site may be in-doors or out-of-doors. An in-door site, as an example, may be a moderately sized gymnasium. For out-of-door use, arena 2 withstands wind loads as well as body loads which occur during physical activity associated with line-of-sight competition Arena 2 is assembled as a unit where each vertical edge of each assembled panel is releasibly affixed to another vertical edge of an adjacent assembled panel. Further, a plurality of braces are releasibly, but firmly affixed at the top and floor of arena 2 to provide a structure which is rigid in three dimensions.

Generally, arena 2 comprises a plurality of exterior wall members 10, interior wall members 20, and a floor surface covering 30. Further, arena 2 comprises a plurality of braces, superiorly disposed braces 40, triangular stabilizers 50, and floor support brackets 60. A plurality of brackets 60 are better seen in FIG. 3. As seen in FIG. 1, the exterior wall members 10 and interior wall members 20 are disposed to form a maze characterized by adjacently disposed openings, hallways or doors and solid wall members. Although a single arena 2 layout is disclosed as the currently preferred embodiment, the size and layout of arena 2 may be varied broadly within the scope of this invention. However, in each embodiment of the invention, the exterior wall members 10 and interior wall members 20, are releasibly affixed by at least a portion of each vertical side to at least one other exterior wall member 10 or interior wall member 20, thereby forming a unitized construction.

As arena 2 can be used either in-doors or out-of-doors, a plurality of braces 40, stabilizers 50, and brackets 60 are releasibly affixed to provide support against wind and body loads.

Exterior wall members 10 comprise a plurality of screened panels 100 and at least two superiorly disposed doorway supports 102, one disposed on each end, 106 and 108 of arena 2. Disposed under doorway support 102 is a doorway 104 which provides access for to arena 2. Exterior wall members 10 also comprise a solid panel 110 adjacent each doorway 104 such that a participant can remain unobserved near an entrance doorway 104 prior to entry into arena 2.

Figure 3:
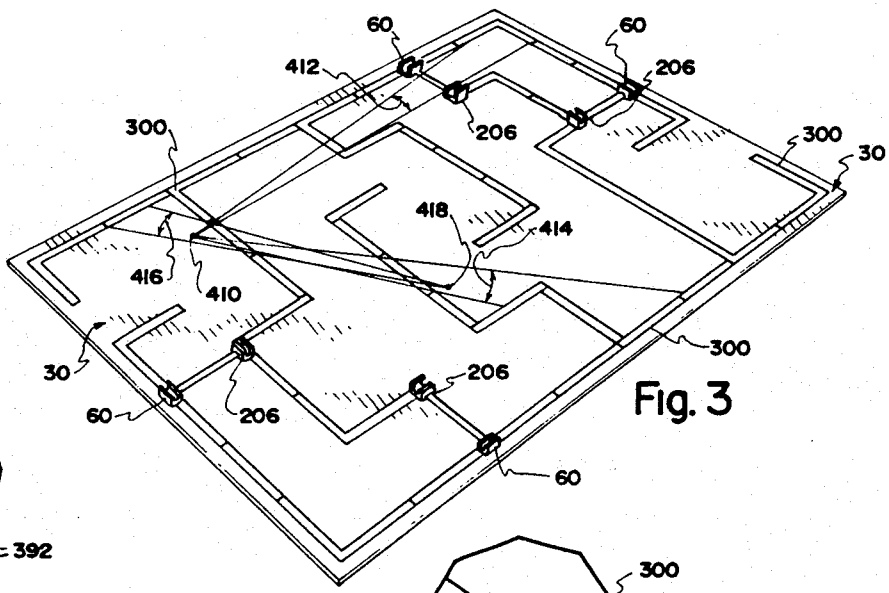
FIG. 3 is a perspective of a floor covering and associated floor support brackets for the arena.
Figure 4:
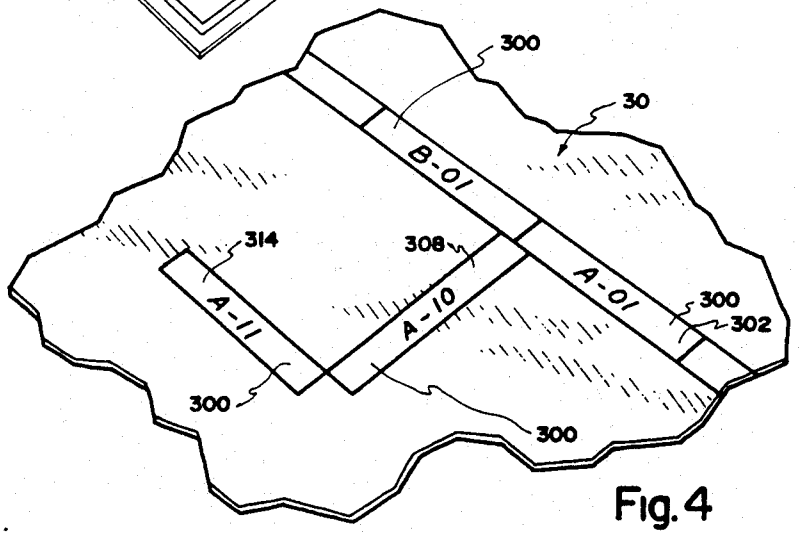
FIG. 4 is a magnified section of a floor covering for the layout of parts seen in FIG. 2.

As seen in FIG. 1, interior wall members 20 comprise solid panels 200, doorway and window supports 202 and half-height window panels 204. A door opening 206 is disposed beneath each doorway support 202. At the foot of each doorway 206 which is adjacently disposed an exterior wall member 10, an exteriorinterior wall bracket 60 is disposed. The location of each bracket 60 in the currently preferred embodiment is best seen in FIG. 3. Otherwise, floor covering 30 is seen unobstructedly therein. Floor cover 30 may be made from outdoor carpeting or other material which can withstand both the weather and abuse by participants. As seen in FIG. 3, a place for each exterior wall member 10 and interior wall member 20 is clearly marked on floor cover 30. Other marks on floor cover 30, not seen in FIG. 3, for other parts such as a mark for a support 102 is provided where appropriate. Each mark, generally identified by indicia 300, maps a particular site for a screen panel 100, a solid exterior panel 110, a solid interior panel 200 or a halfheight panel 204. Bracket support locations are also identified on carpet 30. As best seen in FIG. 4, each mark comprises indicia 300 which are directly related to similarly numerated indicia on panels to be disposed thereat. As an example, indicia A-01 as seen in FIG. 4 on mark 302 is repeated on identification plate 304 seen in FIG. 2 on a base member of panel 306. Similarly, the indicia on mark 308 matches identification plate 316 on panel 312, and indicia on mark 314 matches identification plate 316 on panel 318. It should be noted that the configuration of panels as seen on FIG. 2 is not found in FIG. 1 in the currently preferred embodiment.

Figure 2:
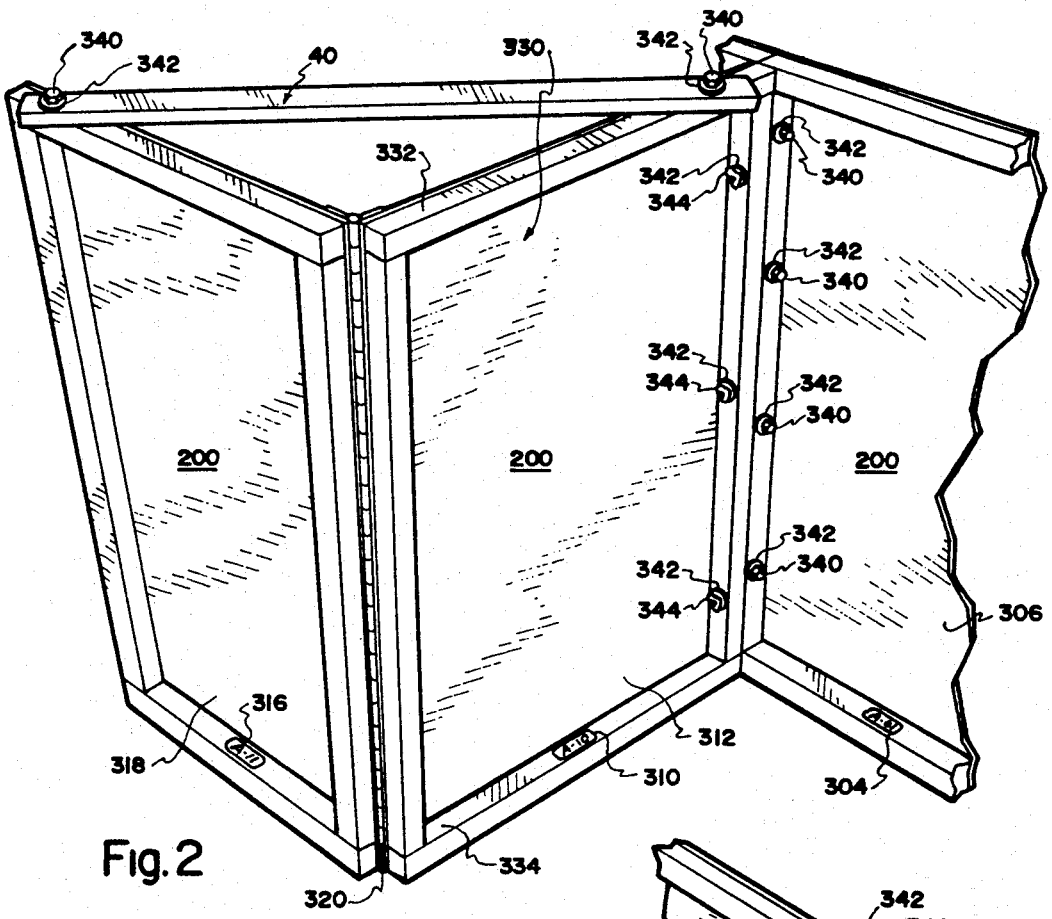
FIG. 2 is a perspective of a portion of an interior wall section of an arena wherein two methods for interconnecting interior wall panels are seen.

The configuration seen on FIG. 2 is provided for clarity for the reader such that two methods for joining panels are seen in one figure for brevity. Two methods for joining panels are seen in FIG. 2. Each method joins adjacent panels on a vertical edge while providing no visible pathway there between. A blind hinge 320 hingeably joins panel 318 to panel 312 such that when panels 312 and 318 are separated from adjoining panels and braces such as brace 40 seen in FIG. 2, panels 318 and 312 are folded together and carried off as a unit for transport to the next site. Therefore, blind hinge 312 is permanently affixed to each panel 318 and 312 by screws or the like and not removed when arena 2 is dismantled.

Each solid panel 110 and 200 comprises a solid facing board 330, a top edge framing member 332, a bottom edge framing member 334, a left-hand vertical edge framing member 336, and a righthand vertical framing member 338. Each edge framing member 332, 334, 336, 338 is permanently affixed to facing board 330 to complete fabrication of solid panel 200. Each edge framing member may be formed of 2 × 2 pine or when better weathering or stronger material is required for particular environments, a hybrid material such as PARALLAM may be used. PARALLAM is available from MacMillan Bloedel Parallam Division, MacMillan Bloedel, 436 East Dougherty Street, Athens, Ga. 30601. Vertical edge framing members 336 and 338 provide vertical edge support as well as a connecting plate whereby an adjacent edge framing member is releasibly affixed as seen in FIG. 2. Facing board 330 may be made of ½ inch CDX grade plywood or wafer board. Half-height window panes comprise construction patterns and parts which are similar to solid panels 200 but shorter in height, thereby providing an opening or window where used.

Figure 5:
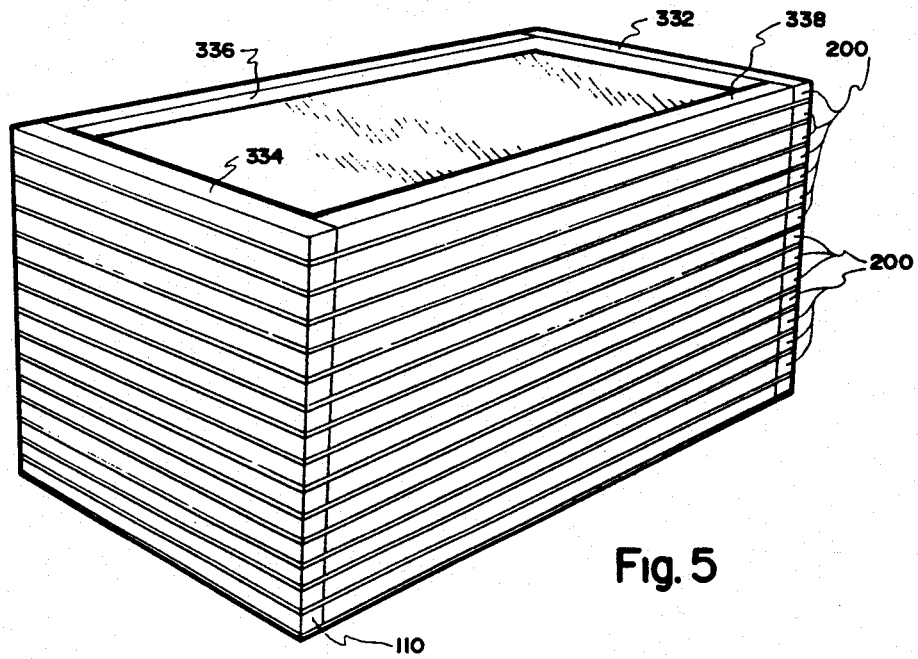
FIG. 5 is a stack of disassembled wall panels used in an arena.

Each adjacent edge framing member comprises holes juxtaposed one with the other. Adjacent vertical edge framing members are releasibly affixed together by inserting a bolt 340 through a washer 342 and into the juxtaposed holes disposed in the adjacent vertical edge braces. Upon the exposed threaded end of bolt 340, another washer 342 is placed followed by a threadably tightened attachment of a wingnut 344. As is apparent to one skilled in the art, other attaching devices may be used in place of bolt 340 and wingnut 344 and washer 342. Different than hinge 320 which is permanently attached to two adjacent panels 200, removal of bolt 340, washer 342, and wingnut 344 from each juxtaposed holes permits previously affixed vertical edge members to be separated and the panels to be separately stacked for transport. A stack ready for transport of a plurality of solid interior panels 200 and one solid exterior panel is seen in FIG. 5. Parts for the complete structure seen as arena 2 in FIG. 1 with all panels, braces, stabilizers, brackets, and fasteners; folds, interlocks, and stacks into an eight foot by eight foot by five foot package.

Figure 6:
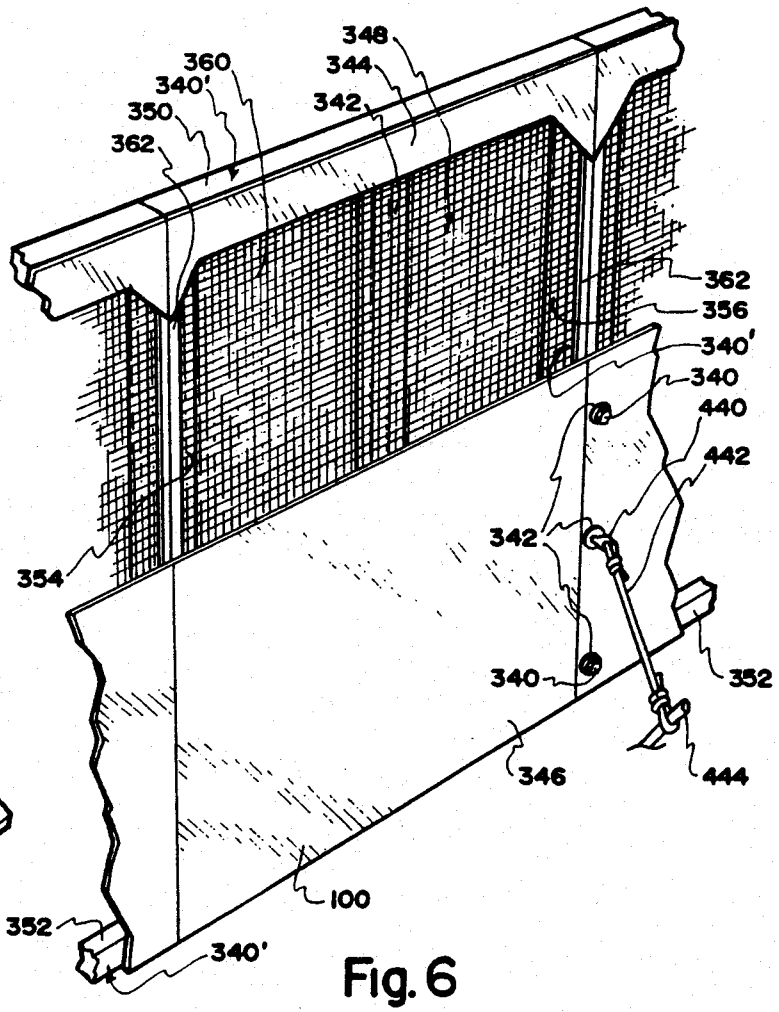
FIG. 6 is a perspective of a section of an exterior wall of an arena.

As seen in FIG. 6, each screened panel 100 comprises edge framing members, generally designated 340', a central edge framing member 342', a top band 344', a bottom panel 346, and an upper screened panel 348. Edge framing members 340' further comprise a top framing member 350, a bottom framing member 352, and, as viewed from the exterior of arena 2, a left vertical edge framing member 354 and a right vertical edge framing member 356. Each left vertical edge framing member 354 and right vertical edge framing member 356 comprises a plurality of holes (not shown) wherethrough attaching parts are inserted to releasibly attach an adjacent right vertical edge framing member 35 and left vertical edge framing member 354, respectively. Attachment parts and procedures are substantially the same as those described for releasibly adjoining interior panels 200, earlier related and seen in FIG. 2.

When arena 2 is assembled out-of-doors, an eyebolt 440 is used in place of a bolt 340, where a staked tie-down is provided As seen in FIG. 6, eyebolt 440 is tautly connected by tether 442 to a stake 444 anchored in the ground to provide additional resistance against wind load.

Substantially the lower half of each screened panel 100 is covered by bottom panel 346. In the currently preferred embodiment, bottom panel 346 is made of a solid piece and may be fabricated from ½ inch CDX grade plywood or wafer board. One type of wafer board which may be used is STURDI-WOOD, a registered trademark of Weyerhauser.

The upper half of each screened panel 100 comprises upper screened panel 348. Upper screened panel 348 comprises screening 360 which essentially covers areas of each screened panel 100 not covered by bottom panel 346. Mesh size of screening 360 is a trade-off between the requirements for accessible viewing from the outside of the arena and restricting projectiles discharged within the arena from exiting the arena and striking a viewer. While mesh sizes may change as different projectiles are used, a screen comprising a typical ¼ inch mesh may be used. Edge protecting strips 362 are disposed along the vertical sides of upper screened panel 348 to protect the screening 360 and handler of each screened panel 100 during assembly and use of arena 2.

Edge framing members 340' frame the periphery of screened panel 100 and may be fabricated from pine 2 × 2's When expected body or wind loads exceed the stress capacity of pine 2 × 2's a hybrid material such as PARALLAM available from MacMillan Bloedel Parallam Division, MacMillan Bloedel, 436 East Dougherty Street, Athens, Ga., 30601 may be used. Central framing member 342' is vertically and centrally disposed between vertical edge framing members 336 and 338 and provides a vertical central framing member for screened panel 100.

Figure 7:
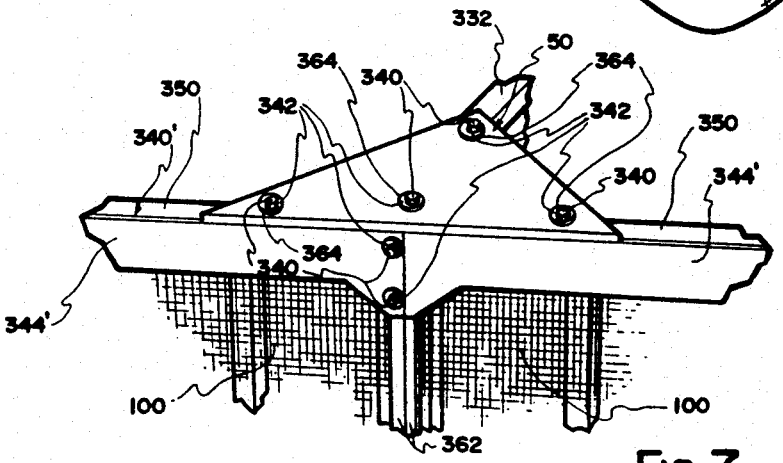
FIG. 7 is perspective of an exterior wall section of an arena showing a stabilizer which comprises a strengthening top connection among two exterior wall panels and an interior wall.

Top band 344' is disposed substantially across the top of screened panel 100. So disposed, top band 344' protects the upper edge of the screening 360 and provides a decorative finish at the top of each screened panel 100. Edge framing members 340', screening 360, top band 344', and bottom panel 346 are affixed one to the other at adjoining points by screws or the like.

Where two adjacent joined screened panels are further connected to an interior solid panel 200, a stabilizer 50 is often employed as seen in FIGS. 1 and seen magnified in part in FIG. 7. As seen therein, stabilizer 50 comprises a triangular shaped piece. Each stabilizer 50 comprises a series of holes 364 patterned to be juxtaposed holes (not shown) in the associated top edge framing members 332 and 350. Stabilizer 50 is releasibly, but firmly affixed by bolts 340, washers 342, and nuts such as wing nuts 344 as earlier described for the joining of interior panels.

Figure 8:
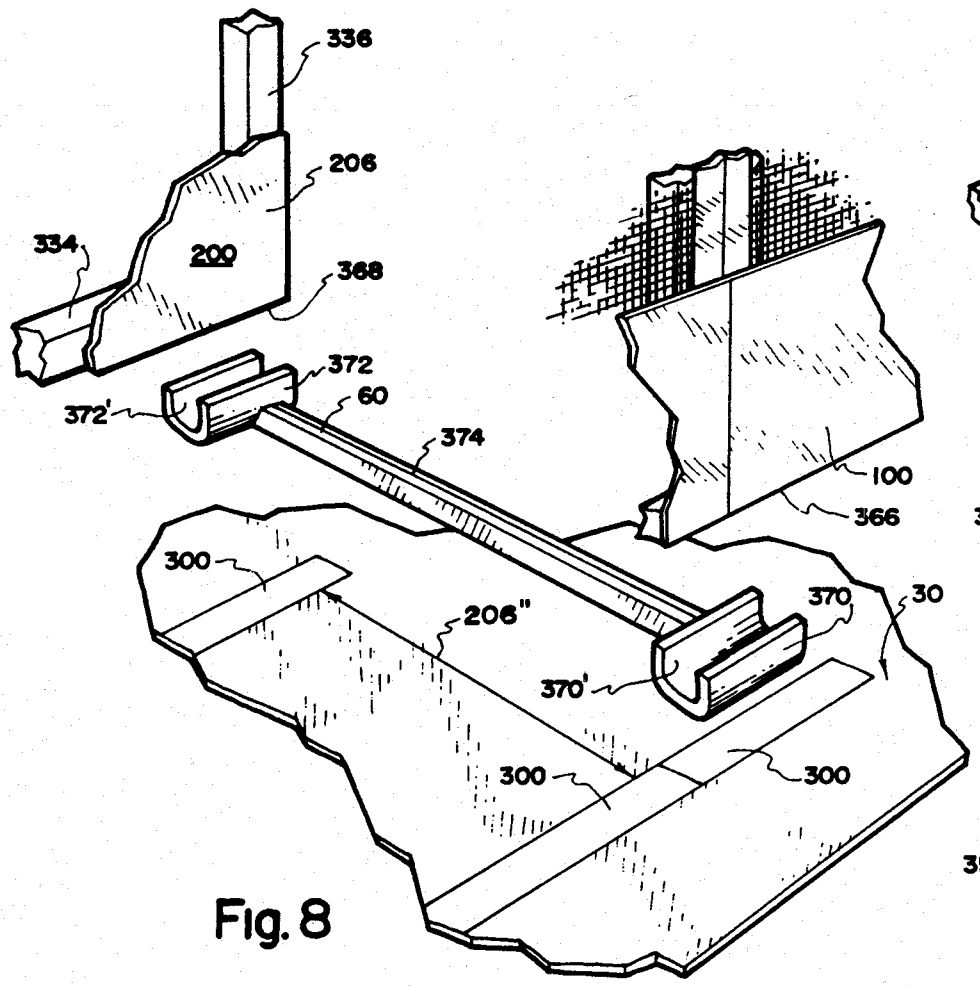
FIG. 8 is a perspective of the floor support bracket and segments of the associated floor covering and interior and exterior wall panels which define an interior doorway or hallway.
Figure 14:
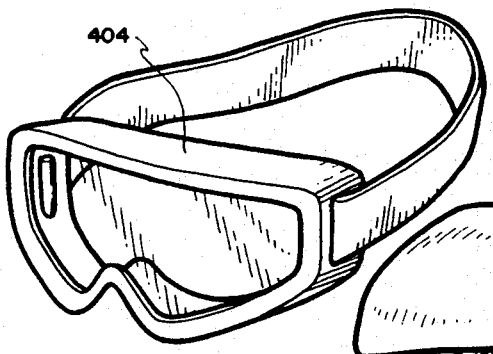
FIG. 14 is a perspective of protective goggles worn by the participant of FIG. 11.

When a interior doorway 206 and associated hallway 206" is disposed adjacent an exterior screened panel, anticipated wind and body loads require cross doorway 206 and associated hallway 206" support across both the top and floor of doorway 206. Bracket 60 is seen disposed across each such doorway 206 in FIG. 3. An exploded perspective showing segments of floor covering 30 with pattern defining indicia 300, bracket 60, associated exterior screened panel 100 and interior solid panel 200 is seen in FIG. 8. As seen therein, bracket 60 is disposed between indicia 300 which define an interior doorway 206 and associated hallway 206".

Bracket 60 comprises a U-shaped channel part 370 placed on top of the indicia 300 which defines the line of assembly of exterior screened panels 100. U-shaped channel part 370 comprises an interior channel 370' which snugly, but releasibly accepts the bottom 366 of screened panel 100. Another U-shaped channel part 372 is placed on top of the indicia 300 which defines the position of the interior vertical edge of doorway 206 as demarcated by interior solid panel 200. U-shaped channel 372 part comprises an interior channel 372' which snugly, but releasibly accepts the bottom 368 of interior solid panel 200.

During assembly, bracket 60 is disposed across the space which provides the foot of doorway 206 or is interposed between an exterior panel 10 and interior panel 20 whereat an associated hallway 206" is thereby defined. The bottom 366 of screened panel 100 is snugly secured into channel 370'. Similarly the bottom 368 of interior solid panel 200 is snugly secured into channel 372' Each channel part 370 and 372 may be made from steel U-channel stock.

Figure 9:
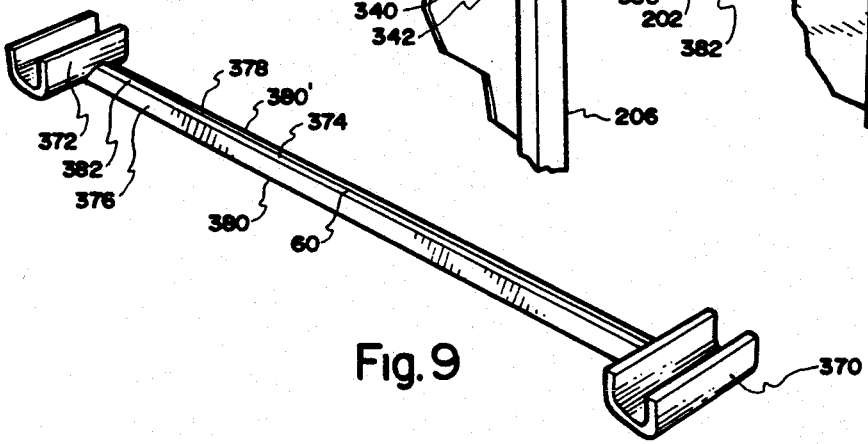
FIG. 9 is a perspective of the bracket seen in FIG. 8.

Bracket 60 is seen alone in FIG. 9. As seen therein, a cross member 374 is disposed between channels parts 370 and 372 to substantially define the width of the doorway 206 or associated hallway 206" wherein bracket 60 is disposed and used. Thus the length of cross member 374 is essentially the width of the doorway 206 and associated hallway 206". Cross member 374 is formed of right angle stock, comprising two sides 376 and 378, each side being of sufficient thickness that a portion of the stock at the site of the right angle can be removed without separating or unduly weakening cross member 374. As seen in FIG. 9, cross member 374, after a portion of the stock at the right angle has been removed, is disposed with open edges 380 and 380' disposed toward the supporting floor. A flat 382 formed when the portion of the right angle stock is removed is then horizontally disposed at the top surface of cross member 374, thereby providing a low profile structure at the base of door 206 when installed thereat. Cross member 374 may be made from right angle steel stock and joined to channels 370 and 372 by welding or the like.

Figure 10:
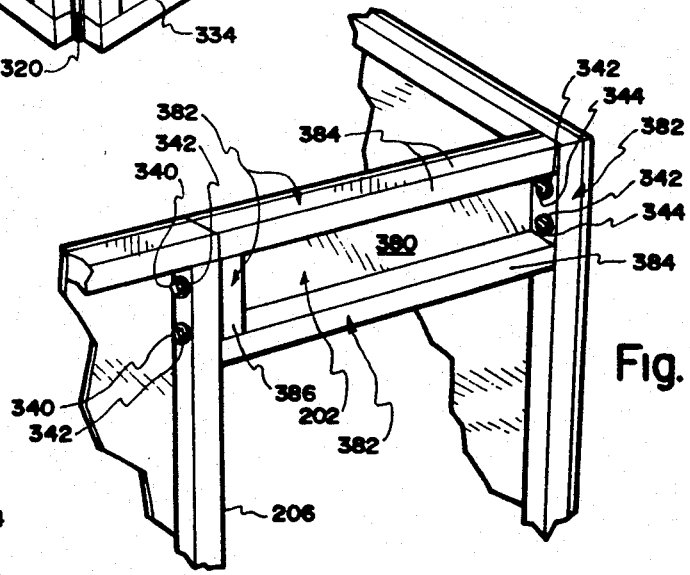
FIG. 10 is a perspective of an overhead support and segments of associated releasibly attached panels.

The top of each doorway 206 is framed and supported by a support 202. As seen in FIG. 1, a support 202 may also be used for support above a half height interior panel 204 to define a window 206' and provide additional support as required As seen in FIG. 10, support 202 comprises a facing panel 380 and edge framing members, generally designated 328, normally made from the same material used for interior solid panel 200. Framing members 382 comprise an identical top and a bottom member generally designated 384 and identical vertical edge members both of which are designated 386. Top and bottom members 384 disposed horizontally at the top and bottom, respectively, of support 202, essentially define the width of the span of the doorway 206 and associated hallway 206" or window 206'. Vertical edge members 386 are disposed between top and bottom members 384 and comprise holes (not shown) for connecting bolts 340 which are used with bolts 340, washers 342, and wingnuts 344 to make releasible connections to adjoining panels as earlier described.

Figure 11:
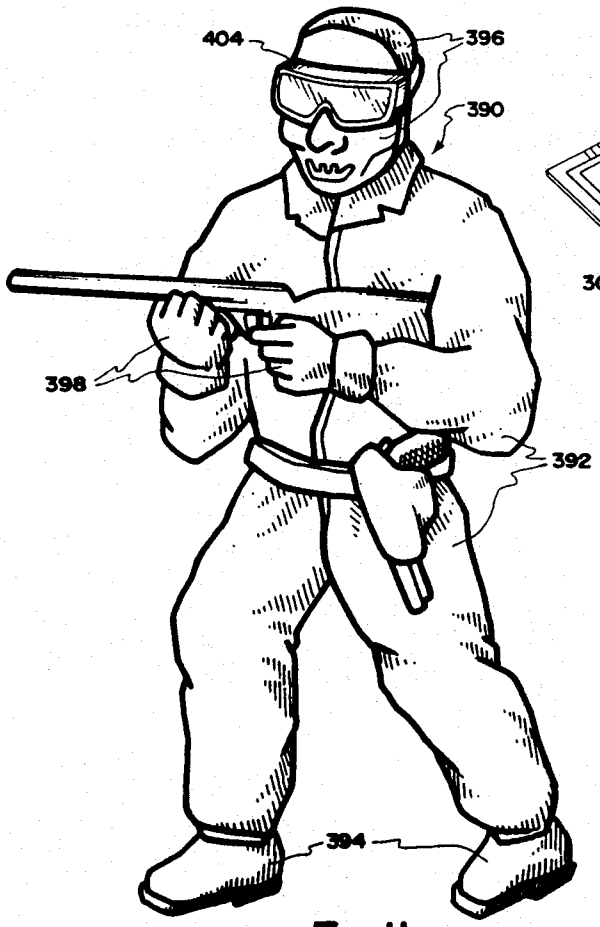
FIG. 11 is a perspective of a fully garbed participant.

In line-of-sight activities wherein projectiles comprising paintballs and the like are fired between combatting personnel, protection must be provided to participants. As seen in FIG. 1, participants, which may number two or more, are seen as team members 6 and opposing team members 8. Judges or instructors 4 are located outside the arena and view the activities through a screened panel 100. As each participant is free to course through the maze of arena 2 from entry to entry, paintballs or other projectiles may be discharged at close range. A garbed individual 390 dressed for participation in arena 2 is seen in FIG. 11. Dressed individual 390 comprises loose fitting coveralls 392, protective footwear 394, headgear 396, and gloves 398. Each piece of clothing is sufficiently loose to allow dressed individual 390 to receive a hit without feeling sting or experiencing injury upon impact.

Figure 13:
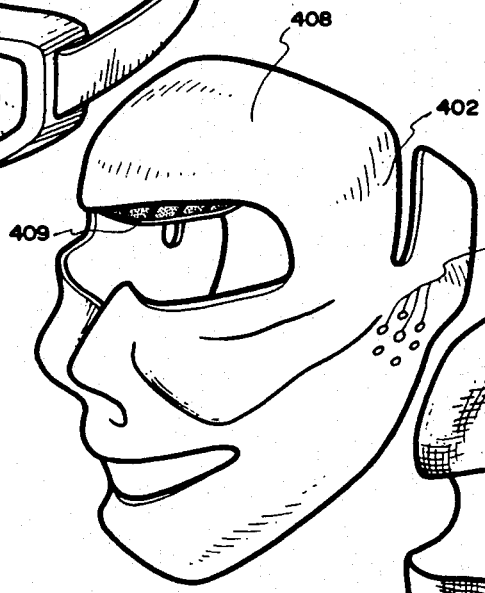
FIG. 13 is a perspective of the protective mask worn by the participant of FIG. 11.
Figure 12:
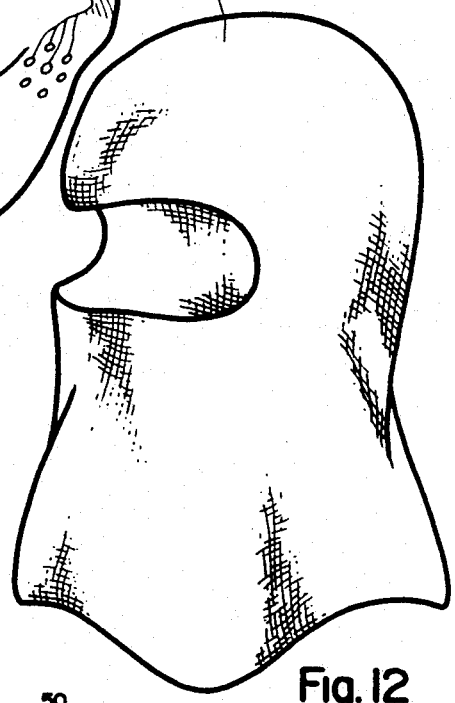
FIG. 12 is a perspective of the head cover worn by the participant of FIG. 11.

Headgear 396 comprises a hood 400, a mask 402, and goggles 404. Hood 400, best seen in FIG. 12, provides protection for ears and areas of the head and upper torso not otherwise protected. Face mask 402, seen in FIG. 13, provides protection for facial areas. Face mask 402 comprises a plurality of holes 406 for passage of air and an extended full face, ear, temple, and throat area cover 408. In addition a pad 409 which resides behind forehead cover 408, displaces the mask forward from the head of individual 390 providing a space therebetween for eyeglasses. Pad 409 may be made from a pliant foam synthetic resinous material. In an alternative currently preferred mask embodiment, a welders type of headband (not shown) may be used in lieu of pad 409 to allow the mask to be raised and lowered without mask removal and to allow room for glasses without pad 409. Goggles 404, seen in FIG. 14, fit across mask 402 to provide protection for the eyes of individual 390. All of the garb for individual 390 is well known and widely available in the art except for a mask 402 with an extended forehead protector and pad 409.

As earlier mentioned, floor cover 30 provides a plan for assembling arena 2. Each of the major parts used comprising interior solid panels 200, half height panels 204, and exterior panels 100 and 110 comprise labels on each panel which matches indicia 300 printed on floor cover 30. To provide superiorly disposed braces, stabilizers 50 and braces 40 are strategically placed and releasibly secured as best seen in FIGS. 1 and 2.

A place for a goal defining article such as a flag 70 is normally marked at the geometric center of arena 2. See FIG. 1. Usually participants enter arena 2 simultaneously at external doorways 104. The plan of arena 2 permits only limited and controlled line-of-sight pathways. Three such pathways are seen in FIG. 3. As seen therein, one participant 6 is assumed to disposed at a site 410. From site 410, participant 6 has a view which comprises a viewing angle indicated by arrow 412 and another viewing angle indicated by arrow 414. A competing participant 8 is assumed to be disposed at a site 418 and has a viewing angle toward participant 6 by a viewing angle defined by arrow 416. As an example, note that the participant at site 410 cannot safely concentrate solely on the viewing angle indicated by arrow 412. It is important that arena 2 be laid out to provide multiple viewing angles to exercise the awareness of each participant. It is equally as important that no unplanned visual pathways be provided such as at sites where panels join. For this reason, the panels tightly join and, where hinges are used, the hinges are blind hinges.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A compactible, portable, indoor/outdoor arena assembly for armed competition, the assembly comprising subassemblies which are manually disassembled from each other at one site for stacking and transportation to another site and facilely, manually assembled for use at the other site, said arena, comprising:
   - exterior wall subassemblies for the arena;
   - interior wall subassemblies for the arena;
   - visual openings within at least selected ones of the interior wall means of the arena;
   - the visual openings comprising means for providing competitive participant travel and projectile routes through selected interior wall subassemblies within the arena;
   - removable connector means for selectively interconnecting at least some of the exterior wall subassemblies to other exterior wall subassemblies, at least some of the exterior wall subassemblies to predetermined interior wall subassemblies and at least some of the interior wall subassemblies to selected other interior wall assemblies;
   - bracing means for bracing at least some of the exterior and interior wall subassemblies to withstand loads expected to be imposed thereon.

2. The compactible, portable, indoor/outdoor arena according to claim 1 wherein at least some of the exterior wall subassemblies comprise means for observer viewing the interior of the arena from the exterior of the arena.

3. The compactible, portable, indoor/outdoor arena according to claim 2 wherein the viewing means comprise mesh means which provide for visual observation therethrough and inhibition of passage of liquid from a liquid containing projectile therethrough.

4. The compactible, portable, indoor/outdoor arena according to claim 1 wherein at least one of the exterior wall subassemblies comprise doorway means whereby competitive participants enter the arena.

5. The compactible, portable, indoor/outdoor arena according to claim 1 wherein at least one of the exterior wall subassemblies comprise doorway means which comprise at least two doorways whereby at least two competitive participants respectively enter the facility from opposing sides of the arena.

6. The compactible, portable, indoor/outdoor arena according to claim 1 wherein at least some of the exterior wall subassemblies comprise visual obstructing means whereby movements of a competitive participant prior to entry into the arena are hidden from view.

7. The compactible, portable, indoor/outdoor arena according to claim 1 wherein the removable connector means comprise releasible connecting means.

8. The compactible, portable, indoor/outdoor arena according to claim 7 wherein the releasible connecting means comprise bolt and nut means.

9. The compactible, portable, indoor/outdoor arena according to claim 8 wherein the bolt and nut means comprise eyebolts used to secure the exterior wall subassemblies to interior wall subassemblies in erect condition and used to attach tie-downs to stakes to secure exterior wall subassemblies to the ground in an erect condition in the out-of-doors against movement due to wind load.

10. The compactible, portable, indoor/outdoor arena according to claim 8 wherein the bolt and nut means comprise wing nuts.

11. The compactible, portable, indoor/outdoor arena according to claim 1 wherein the removable connector means comprise hinged connector means.

12. The compactible, portable, indoor/outdoor arena according to claim 1 wherein the removable connector means comprise vision barrier means whereby visual observation along the length of the removable connector means are impeded.

13. The compactible, portable, indoor/outdoor arena according to claim 1 further comprising subassembly identifying means.

14. The compactible, portable, indoor/outdoor arena according to claim 1 further comprising position demarcating means which comprise means for covering the ground or floor where the subassemblies of the arena are assembled into the arena.

15. The compactible, portable, indoor/outdoor arena according to claim 14 wherein the covering means comprise position identification indicia.

16. The compactible, portable, indoor/outdoor arena according to claim 14 wherein the covering means comprise carpet means.

17. The compactible, portable, indoor/outdoor arena according to claim 13 wherein the identifying means comprise tags or plates bearing component identification indicia and the position demarcating means comprise position identification indicia.

18. The compactible, portable, indoor/outdoor arena according to claim 17 wherein the part identification indicia and the position identification indicia are common.

19. The compactible, portable, indoor/outdoor arena according to claim 1 wherein the bracing means comprise stabilizer means.

20. The compactible, portable, indoor/outdoor arena according to claim 1 wherein the bracing means comprise cross braces.

21. The compactible, portable, indoor/outdoor arena according to claim 1 wherein the bracing means comprise floor supports.

22. A system for armed competition comprising:

a compactible, portable, indoor/outdoor arena, components of which are manually disassembled from each other for stacking and transportation to another site and facilely, manually assembled to each other into the arena for use at the other site, said arena comprising:

means defining exterior walls for the arena;

means defining interior walls for the arena to simulate rooms;

means defining visual pathways across interior walls within the arena;

the means defining visual pathways comprising means providing for travel by a competitive participant within and between simulated rooms within the arena;

stabilizing means spanning across at least some of the visual pathways to strengthen the same;

means for structurally bracing between exterior and interior walls;

protective clothing means for covering a competitive participant whereby the competitive participant remains mobile but safely protected from injury caused by a projectile used in the competition.

23. The system for armed competition according to claim 22 wherein the exterior walls comprise viewing means for observing the interior of the arena from the exterior of the arena.

24. The system for armed competition according to claim 23 wherein the viewing means comprise mesh means which accommodate visual observation and substantially prevent injury or damage to an exterior observer due to liquid from a projectile.

25. The system for armed competition according to claim 22 wherein the exterior walls comprise doorway means whereby at least one competitive participant enters the arena.

26. The system for armed competition according to claim 22 wherein the exterior walls comprise at least two doorways whereby at least two competitive participants separately enter the facility from different sides of the arena.

27. The system for armed competition according to claim 22 wherein the exterior walls comprise visual pathway obstructing mean whereby movements of a competitive participant prior to entry into the arena are hidden from view along otherwise visual pathways within and without the arena.

28. The system for armed competition according to claim 22 wherein the stabilizing interconnecting means comprise releasible connecting means.

29. The system for armed competition according to claim 28 wherein the releasible connecting means comprise bolt and nut means.

30. The system for armed competition according to claim 29 wherein the bolt and nut means comprise wing nuts.

31. The system for armed competition according to claim 22 wherein the stabilizing interconnecting means comprise hinged connector means.

32. The system for armed competition according to claim 22 wherein the stabilizing interconnecting means comprise vision impairing means whereby visual pathways along the length of the interconnecting means are obstructed.

33. The system for armed competition according to claim 22 further comprising component identifying means.

34. The system for armed competition according to claim 22 further comprising position demarcating means for covering the ground or floor whereupon the arena is assembled.

35. The system for armed competition according to claim 22 further comprising position demarcating means which comprise visual position identification indicia.

36. The system for armed competition according to claim 34 wherein the position demarcating covering means comprise carpet means.

37. The system for armed competition according to claim 22 further comprising component identifying means comprising part identification indicia and position identification indicia.

38. The system for armed competition according to claim 37 wherein part identification indicia and the position identification indicia are common.

39. The system for armed competition according to claim 22 wherein the structurally bracing means comprise stabilizer means.

40. The system for armed competition according to claim 22 wherein the structural bracing means comprise cross braces interposed between adjacent walls.

41. The system for armed competition according to claim 22 wherein the structurally bracing means comprise brackets.

42. The system for armed competition according to claim 22 wherein the protective clothing means comprise means for masking the face of the participant.

43. The system for armed competition according to claim 42 wherein the protective clothing means comprise full face, ear, temple, and throat area protection means.

44. The system for armed competition according to claim 42 wherein the protective clothing means comprise headband means which separate the masking means from the face of the participant, thereby providing an offset which permits a participant to wear glasses while using the masking means.

45. A method of erecting and using an arena for simulated armed combat comprising the steps of:

erecting an exterior wall in vertically directed orientation to define a perimeter of the arena having at least one opening for ingress and egress of a combatant;

erecting interior walls in vertically directed orientation to define a plurality of simulated rooms comprising openings between a maze of simulated rooms and barrier regions which obstruct lines of sight between adjacent simulated rooms;

joining the interior and exterior walls together with structural connectors into a stable, unified maze assembly;

causing at lest two combatants to enter the interior of the maze arena and to engage in simulated combat on a room-to-room basis within the maze arena.

46. A method according to claim 45 further comprising the step of placing openings in interior walls for ingress and egress of combatants between rooms and at least one combatant observation opening in interior walls.

47. A method according to claim 45 further comprising the step of placing at least one observation opening in the exterior wall for observation by non-combatants.

48. A method according to claim 47 further comprising the step of placing mesh over the non-combatant observation opening.

49. A method of removably erecting and using an arena for simulated armed combat comprising the steps of:

removably erecting exterior wall panels in vertically directed orientation to define a perimeter of the arena having at least one opening for ingress and egress of a combatant;

removably erecting interior wall panels in vertically directed orientation to define a plurality of simulated rooms comprising openings between a maze of simulated rooms and barrier regions which obstruct lines of sight between adjacent simulated rooms;

joining the interior and exterior walls together with removable structural connectors into a stable, unified maze assembly;

causing at least two combatants to enter the interior of the maze arena and to engage in simulated combat on a room-to-room basis within the maze arena.

50. A method according to claim 49 further comprising the step of disassembling the structural connectors, the interior wall panels and the exterior wall panels for storage or use elsewhere.

51. A maze arena assembly for simulated armed combat comprising:

an erect exterior wall disposed in vertically directed orientation defining the perimeter of the maze arena, the exterior wall comprising at least one opening for ingress and egress of combatants;

erect interior walls disposed in a vertically directed orientation defining a maze of simulated rooms comprising openings between simulated rooms and barrier regions which obstruct lines of sight between adjacent simulated rooms;

structural connectors spanning between the exterior and the interior walls holding said walls in stable, unified relation.

52. A maze arena assembly for simulated armed combat comprising:

an erect exterior wall panels removably disposed end-to-end in vertically directed orientation defining the perimeter of the maze arena, at least one of the exterior wall panels defining at least one opening for ingress and egress of combatants;

erect interior wall panels removably disposed in a vertically directed orientation defining a maze of simulated rooms comprising opening between simulated rooms and barrier regions which obstruct lines of sight between adjacent simulated rooms;

removable structural connectors spanning between the exterior and the interior wall panels holding said wall panels in stable, unified, erect, disassemble relation.

* * * * *